United States Patent [19]

Seidman

[11] Patent Number: 4,901,409

[45] Date of Patent: Feb. 20, 1990

[54] ORNAMENTAL EARRING SOUNDING A CLICK UPON ATTACHMENT

[76] Inventor: Sheldon Seidman, 709 Ave. K, Brooklyn, N.Y. 11230

[21] Appl. No.: 192,376

[22] Filed: May 10, 1988

[51] Int. Cl.[4] ..... A44C 7/00

[52] U.S. Cl. ..... 24/705; 63/12

[58] Field of Search ..... 63/12, 13, 705, 707.5, 63/108

[56] References Cited

U.S. PATENT DOCUMENTS

| | | | |
|---|---|---|---|
| 335,100 | 2/1886 | Adams et al. | 63/12 X |
| 3,040,406 | 6/1962 | Artzt | 63/12 X |
| 4,170,118 | 10/1979 | Block | 63/12 |
| 4,195,492 | 4/1980 | Johnson | 63/12 |
| 4,245,484 | 1/1981 | Block | 63/12 |
| 4,299,101 | 11/1981 | Block | 63/12 |
| 4,580,417 | 4/1986 | Sardelli | 63/12 |

*Primary Examiner*—James R. Brittain

*Attorney, Agent, or Firm*—Helfgott & Karas

[57] ABSTRACT

An earring for removable attachment to an earlobe through a pierced passage. The earring includes a post with an ornament on one end and a serrated surface on the other end. A clutch includes leaf springs which produce audible clicks as they engage the serrations when the clutch is pushed onto the post.

5 Claims, 2 Drawing Sheets

ORNAMENTAL EARRING SOUNDING A CLICK UPON ATTACHMENT

BACKGROUND OF THE INVENTION

This invention relates to earrings, and more particularly to an earring having a post with a push on clutch.

A number of different configurations for post-type earrings have been described, for example, in U.S. Pat. No. 4,170,I18, granted Oct. 9, 1979; U.S. Pat. No. 4,236,385, granted Dec. 2, 1980; U.S. Pat. No. 4,245,484, granted Jan. 20, 1981 and U.S. Pat. No. 4,299,101, granted Nov. 10, 1981, all of which are in the name of Alvin Block. In the Block configurations, a threaded post is provided for insertion in a passage through the earlobe of a wearer and an axial pushtype of clutch is attached to the protruding threaded end of the post to secure the earring in place. Block states that the clutch may be disengaged from the post only by rotating the clutch (see, for example, U.S. Pat. No. 4,236,385, Column 2, lines 40–41).

While such arrangements are generally and often satisfactory, it has been found that as a result of the softness of materials used in jewelry, the fingers of the clutch which are intended to engage the post and thereby hold the ornament on a wearer's ear may break off, may become worn over a period of time or simply lose resilience and become too loose to provide the necessary secure engagement to avoid inadvertent loss of the ornament. It is therefore all too often the case that a wearer may discover that a clutch has worked itself loose and the ornament portion of the earring is lost.

SUMMARY OF THE INVENTION

The present invention is directed to providing a relatively simply constructed arrangement which provides a positive indication to the wearer that the fastening means for a post-type earring is operating properly.

Furthermore, the present invention provides relative ease of use by the wearer while insuring secure attachment of the fastening means to a post-type earring.

In accordance with one aspect of the present invention, an ornamental earring for removable attachment to the earlobe of a wearer through a pierced passage in the earlobe comprises a socket member adapted to be disposed on the wearer's earlobe and having an aperture in juxtaposition with one end of the pierced passage. The earring further comprises a stud member having an enlarged ornament portion adapted to be disposed on the earlobe at the other end of the passage and a stem adapted to extend from the ornament portion through the passage and into the socket aperture for releasable retention therein. The stem is provided along at least a portion of its length with a serrated surface comprised of a series of alternate crests and troughs. The socket is provided with leaf spring means for producing audible clicks when alternately engaging successive ones of the crests and troughs while being pushed onto the stem for indicating to the wearer that secure engagement of the stem with the socket has been achieved.

In accordance with another aspect of the present invention, an ornamental earring for removable attachment to the earlobe of a wearer through a pierced passage in the earlobe comprises a socket member adapted to be disposed on the wearer's earlobe and having an aperture in a base portion in juxtaposition with one end of the pierced passage. The earring further comprises a stud member having an enlarged ornament portion adapted to be disposed on the earlobe at the other end of the passage and an elongated stem adapted to extend from the ornament portion through the passage and into the socket aperture for releasable retention therein. The stem is provided along at least a portion of its length with a serrated surface comprised of a series of alternate crests and troughs. The socket is provided with elongated, diametrically opposed leaf spring means extending from the base portion to free ends thereof for alternatively engaging successive ones of the crests and troughs while being pushed onto the stem. Each of the leaf spring means bows outwardly from the base portion, bows inwardly toward the free end and has an elongated aperture intermediate the base portion and free end such that the free ends of the leaf spring means are caused to bear securely against the stem.

DESCRIPTION OF THE PREFERRED EMBODIMENT

Figure 3:
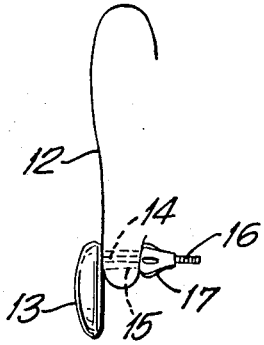
FIG. 3 shows the fastening means of FIGS. 1 and 2 in place on the earlobe of a wearer along with an ornament.
Figure 4:
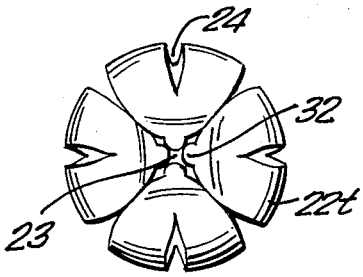
FIG. 4 is a plan view of the fastening means of FIGS. 1 and 2.

Referring to FIG. 3 of the drawing, an ornamental earring is worn on the earlobe 12 of a wearer. An exterior ornament portion 13 is shown in general form and is fastened by any suitable means to a stem 14 which extends through a pierced passage 15 in the earlobe 12. Stem 14 is provided along at least a portion of its length (i.e., the portion which extends to be inside of earlobe 12) with a serrated or threaded surface 16 comprised of a series of alternative crests **16*c* and troughs 16*t* as may better be seen in enlarged FIG. 5**.

A socket member or "clutch" 17 constructed in accordance with the present invention is disposed on the inside of the wearer's earlobe 12 and has a central aperture 18 (see FIGS. 2 and 7–10) which is arranged for juxtaposition with one end of the pierced passage 15 in earlobe 12 for receiving stem 14.

Figure 1:
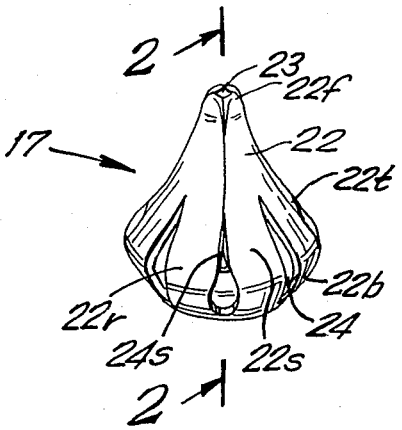
FIG. 1 is an elevation view of one type of clutch or fastening means for a post-type earring constructed in accordance with the present invention.
Figure 2:
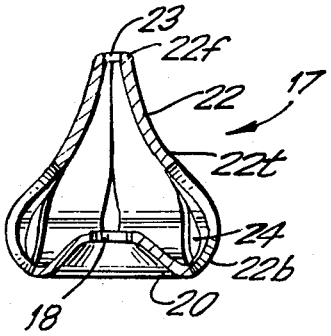
FIG. 2 is a sectional elevation view taken along the line 2—2 of FIG. 1.

Referring now to FIG. 1 in connection with FIG. 2, an enlarged elevation view of the socket member 17 is shown. The socket member 17 is formed into a "tear drop" or "onion" shape from a piece of flat sheet stock having a sufficient spring characteristic for this application. Preferably, the metal alloy known as "Pintong" may be used, an alloy which contains, by weight, 38% silver, 57.4% copper and 4.6% zinc. Suitable surface plating or mixture with precious metals may be employed for socket member 17, according to the aesthetic requirements of the earring.

The socket member 17 comprises a generally circular, dished base portion 20, through which the central aperture 18 is formed for receiving stem 14 (see FIG. 3). A plurality of petal-shaped spring fingers 22 (four are illustrated) arranged in diametrically opposed pairs form the remainder of socket member 17. Spring fingers 22 each have a relatively wide base region **22*b* joined to or integral with base portion 20, a relatively narrow free end 22*f* and a transition region 22*t* extending between base region 22*b* and free end 22*f*. At the beginning of the transition region there is a bend or rib 22*r* in the fingers which forms a belt around the midsection of the fingers aiding in the springy nature of the fingers. The spring fingers 22 initially curve outward from the base portion 20 and then converge so that the free ends 22*f* form an aperture 23 dimensioned so that the free ends 22*f* of fingers 22 engage the troughs 165*t* and crests 16*c* of stem 14**.

The sides **22*s* of spring fingers 22 are shaped so as to abut against each other in the transition region 22*t*. Furthermore, slots 24 are formed in each of the transition regions 22*t*, preferably equidistant between sides 22*s*, and extending from the base region 22*b* outwardly towards free end 22*f*. These slots are closed slots and are in addition to the channels or spaces 24*s* formed between adjacent fingers. The slots 24 each have sides shaped generally similar to the shape of the adjacent sides 22*s* of fingers 22. In the specific arrangement illustrated in the drawing, the sides of slots 24 are curved and are formed as minor segments of two relatively large equal radius intersecting circles, the ends of the slots 24 being the intersections of the circles. Various alternative configuration of slots 24 and spring fingers 22** may also be employed as will appear from the following description.

Referring to FIGS. 6–11, the socket member 17 is constructed according to the present invention in the following manner. A sheet of appropriate material (e.g., "Pintong") is stamped in the shape shown in FIG. 6 to provide four spring fingers 22 joined at base portion 20. Central aperture 18 and slots 24 are then stamped, cut or punched from the flat blank of FIG. 6. Score or fold lines 26, 28 and 30, corresponding, respectively, to the perimeter of circular base portion 20, a line approximately midway between the ends of each of slots 24 forming the ribs **24*r* and a line defining the inner end of a stem engaging tab 32 located at the extremities of each of free ends 22*f*, may be impressed upon the inside surface of socket member 17 (see FIG. 8**).

Figure 5:
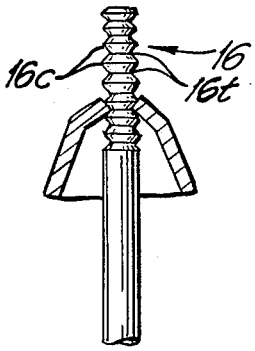
FIG. 5 is an enlarged elevation view of a portion of the fastening means of FIG. 1 in relation to a threaded post as shown in FIG. 3.
Figure 6:
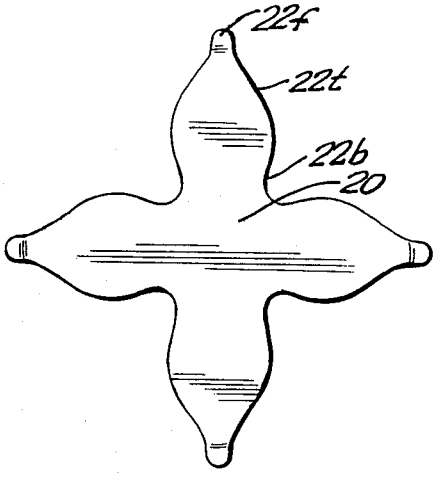
FIGS. 6, 7 and 8 are plan views of various stages of a metal blank prior to its being formed into a fastening means of the type shown in FIG. 1.
Figure 7:
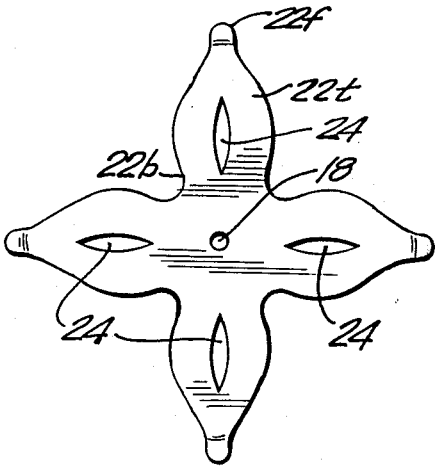
Figure 8:
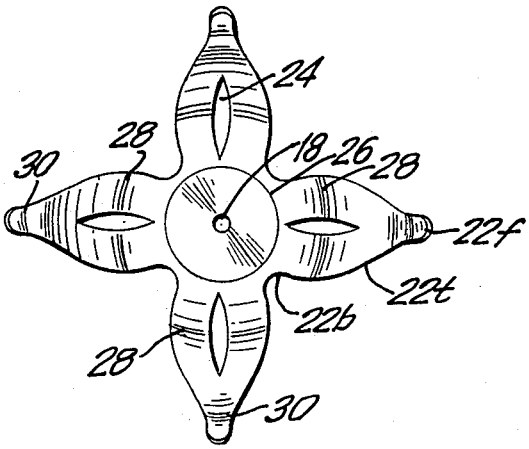
Figure 9:
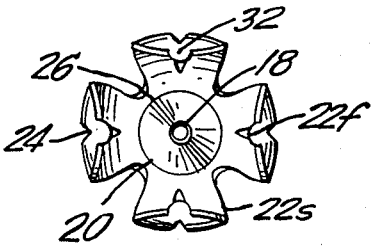
FIGS. 9 and 10 are plan views of the blank of FIG. 8 at various stages of forming.
Figure 11:
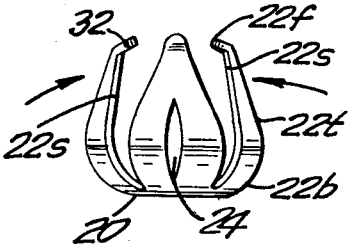
FIG. 11 is an elevation view of FIG. 9.
Figure 10:
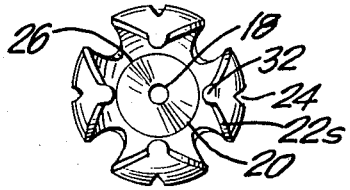

The blank is thereafter formed into the final shape of FIGS. 1–3 by bending the stem engaging tab 32 inwardly, forming the recessed base portion 20, forming the spring fingers 22 to the partially closed shape shown in FIG. 11 and, finally, closing the spring fingers 22 so that the sides **22*s* abut throughout the major portion of their length (see FIG. 1) while, at the same time, the stem engaging tabs 32 form an appropriately sized hole for engagement with stem 16 (see FIG. 5**).

It should be noted that stem engaging tabs 32 preferably engage stem 16 at a relatively sharp angle (i.e., approaching perpendicularity) to ensure proper retention of the position of socket member 17 on stem 14. Furthermore, by virtue of the provision of the slots 24 in the spring fingers 22, there is a greater likelihood of spring fingers 22 retaining their desired shape and close gripping of stem 14 has been observed. The peripheral rib **22*r*** also aids in keeping the fingers rigid and biased inwardly toward the stem.

In the use of the foregoing earring arrangement by a wearer, the stem 14 is inserted into the pierced passage 15 in the wearer's earlobe as shown in FIG. 3. Thereafter, the socket member 17 is positioned on the stem 14 by means of central aperture 18 and the socket member 17 is pushed axially along stem 14. When the stem engaging tabs 32 engage the troughs **16*t* and the crests 16*c* of threaded surface 16 and the socket member 17 is thereafter pushed further onto stem 14, an audible "clicking" sound will be heard by the wearer. This sound is all the more readily perceivable by virtue of the proximity of the sound source (tab 32 and threaded surface 16) to the auditory sensing apparatus of the wearer. The presence of the clicking sound will indicate to the wearer that the tabs 32 are securely engaging the stem 14**.

The number of clicks will provide the wearer with an indication of how far the socket member 17 is from the inner end of stem 14, thereby providing an indication of the margin of safety in fastening which has been realized.

In the absence of clicks, the wearer is forewarned that secure fastening has not been achieved and the apparatus should be examined for damage.

In order to remove the earring, the socket member 17 is simply twisted so as to "unscrew" the socket member 17 from the stem 14.

While the invention has been described in terms of a preferred embodiment, it should be apparent to persons familiar with this art that various modifications may be made without departing from this invention, the scope of which is set forth in the following claims.

What is claimed is:

1. An ornamental earring for removable attachment to the earlobe of a wearer through a pierced passage in the earlobe, said earring comprising:

an elongated socket member including a disk-shaped central base portion and adapted to be disposed on the wearer's earlobe and having an aperture in said base portion in juxtaposition with one end of the pierced passage; and a stud member comprising an enlarged ornament portion adapted to be disposed on the earlobe at the other end of the passage and an elongated stem adapted to extend from said ornament portion through the passage and into said aperture for releasable retention therein;

said stem being provided along at least a portion of its length with a serrated surface comprised of a series of alternate crests and troughs, said socket further including a plurality of individual elongated leaf springs integral with and extending from said disk-shaped base portion to free ends which are formed with stem-engaging tabs adapted to alternately engage successive ones of said crests and troughs while being pushed onto said stem, said leaf springs having sides abutting against each other throughout a substantial portion of their length so as to increase rigidity of said socket, each leaf spring bowing outwardly from said base portion, bowing inwardly towards said free end and having an elongated closed aperture intermediate said base portion and said free end such that said free ends are caused to bear securely against said stem, said tabs being adapted to resiliently snap into a trough and to emit a clicking sound to indicate to the wearer that secure engagement of said stem with said socket has been accomplished.

2. An earring according to claim 1, wherein said socket comprises a peripheral rib at the junction of outwardly bowing and inwardly bowing portions of the leaf springs.

3. An earring according to claim 2, wherein each stem engaging tab extends inwardly towards said crests and troughs at an angle approaching perpendicularity.

4. An earring according to claim 4, wherein each said elongated closed aperture is bound by minor segments of two relatively large radius intersecting circles.

5. An earring according to claim 4, wherein said base portion extends inwardly of the socket member and has a circular side wall widening outwardly from said aperture.

* * * * *